United States Patent [19]

Kjersem

[11] Patent Number: 4,921,304

[45] Date of Patent: May 1, 1990

[54] CHAIR

[76] Inventor: Jens A. Kjersem, Einarvikgaten 1, N-600 Ålesund, Norway

[21] Appl. No.: 848,964

[22] Filed: Apr. 7, 1986

[30] Foreign Application Priority Data

Apr. 10, 1985 [NO] Norway ..... 851435

[51] Int. Cl.[5] ..... A47C 7/02

[52] U.S. Cl. ..... 297/452; 297/458

[58] Field of Search ..... 297/458, 452, 459, 68

[56] References Cited

U.S. PATENT DOCUMENTS

| | | | |
|---|---|---|---|
| 2,281,629 | 5/1942 | Snow | 297/458 |
| 2,411,412 | 11/1946 | Blair et al. | 297/458 X |
| 2,970,638 | 2/1961 | Halter | 297/458 X |
| 3,512,835 | 5/1970 | Flototto | 297/458 |
| 4,214,790 | 7/1980 | Sieber | 297/68 X |
| 4,318,556 | 3/1982 | Rowland | 297/458 |
| 4,334,709 | 6/1982 | Akiyama et al. | 297/458 |
| 4,367,897 | 1/1983 | Cousins | 297/458 |
| 4,489,982 | 12/1984 | Morrow | 297/458 |

*Primary Examiner*—Francis K. Zugel

*Attorney, Agent, or Firm*—Browdy and Neimark

[57] ABSTRACT

A chair comprising a seat and a back rest forming an acute angle with one another is characterized in that the bisectrix of the acute angle forms an angle in the range of 0°–40° with the vertical line and is inclined backwards towards said back rest when the angle between the bisectrix and the vertical direction is more than zero.

2 Claims, 1 Drawing Sheet

CHAIR

The present invention relates to a chair comprising a seat and a back rest supported by an underframe, said seat and back rest being mutually arranged in such a manner that the user is forced to assume a sitting posture with the thighs and the body forming an acute angle, i.e. a so called fetal posture—like a fetus in the womb.

Said "fetal" posture is known from persons sitting in an ordinary chair and raising knees/legs up below the chin. This posture is desired by many people as alternative sitting posture. Probably, this sitting posture was that used by primitive man, and we recognize it from the manner monkeys sit, i.e. an acute angle formed between the thighs and the body, This posture has also been observed in famished persons or mentally ill persons seeking security.

It is an object of the invention to aid persons to assume a fetal posture or an approximate fetal posture. This posture may be connected with biological functions of a psychological or physiological kind. It is energy saving to the body, reducing the total heat exchange/heat loss surface of a person by bringing parts of the body close to each other so that there is less loss of heat. This may be one of the reasons why a person sits like that. A chair aiding a person to assume such a "fetal" posture may also be used in research to examine the biological functions of the body in connection with siad posture. An approximate "fetal" posture with its energy safing effect and relaxing deportment where the back is at ease leaning backwards, the thighs are supported and the calfs are supported so that there is an acute angle of less than 90° between the body and the thighs may, among others, be used in meditation.

A chair resulting in said desired "fetal" posture with the user's back in a relaxed position leaning backwards, etc. as mentioned above, is achieved according to the invention by the fact that the seat and the back rest form an acute angle together and that the bisectrix of said angle forms an angle with the vertical line in the range of 0°–40°.

In order to achieve a comfortable chair another characterizing feature of the chair is that the seat and the back rest are anatomically shaped/padded and with main directional characteristics of the back rest and the seat as indicated in the characterizing part of the following dependent claim 2.

In order to achieve various manner of support of the thighs, the calfs and feet, an alternative embodiment of the chair is provided with adjustable, lockable support members, as stated in the characterizing parts of the following dependent claims 3 and 4.

Figure 1:
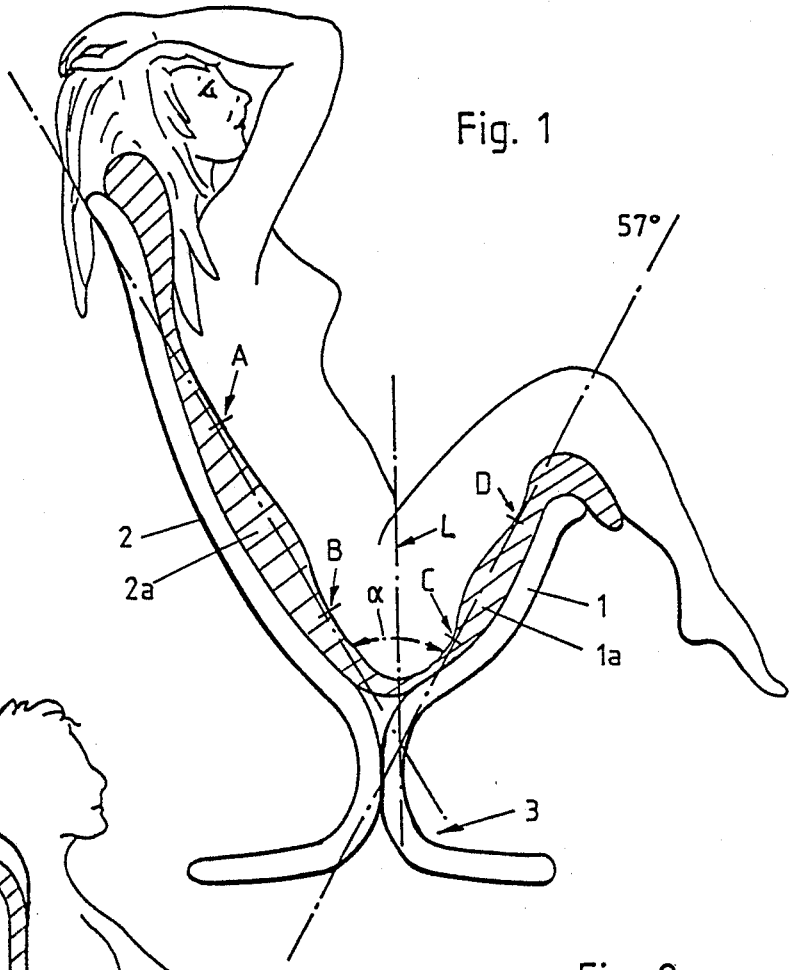
Figure 2:
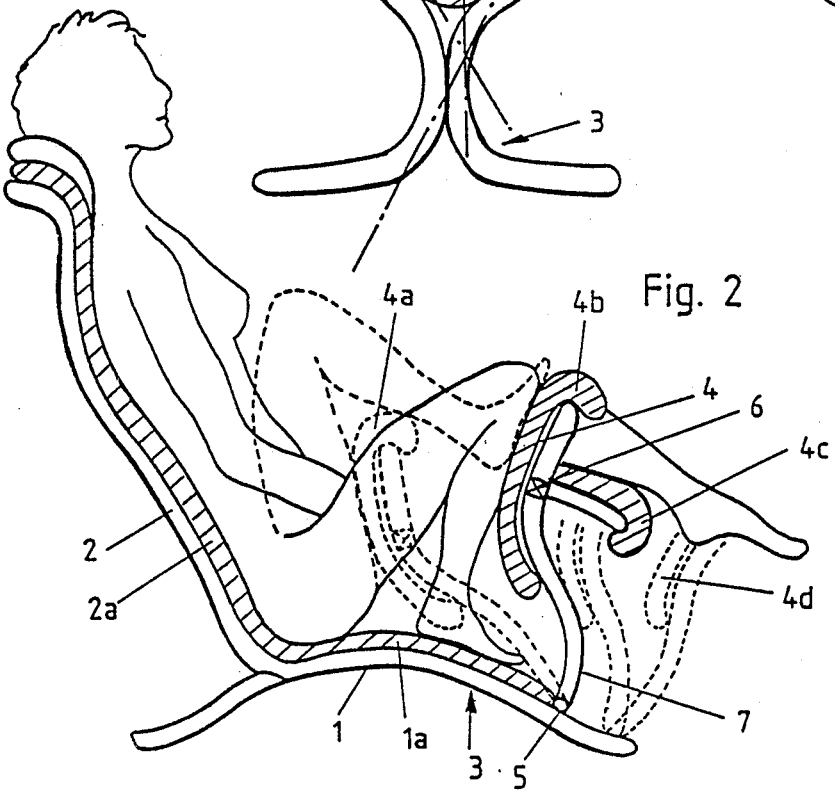

Two embodiments of the chair according to the invention will be disclosed in more detail below with reference to the drawing, where FIG. 1 shows a non-adjustable chair according to the invention with a person sitting in a foetus posture, and FIG. 2 shows an adjustable chair having its supporting member displaced into various supporting positions for the thighs, calfs and feet, respectively.

As shown in FIG. 1, the chair comprises a seat 1 and a high back rest 2, supported by an underframe 3. The seat 1 and the back rest 2 form an acute angle $\alpha$ together and the bisectrix L of the angle $\alpha$ is approximately vertical.

The seat 1 and back rest 2 of the chair are, preferably, anatomically shaped/padded 1*a*, 2*a*, thus, forming a soft support to the thighs as well as the buttocks and the back and, thus, providing good sitting comfort. A line A–B corresponding to the main direction of the back rest is intended to touch two points A, B: namely at the upper portion of the rear of the back—thoracic column A, and at the rear of sacrum with the upper portion of the gluteal muscles B, respectively, of a person sitting in the chair. Another line C–D corresponding to the main direction of the chair seat is intended to touch points C and D: namely the rear/lower side of the bones of the pelvis—ischial tuberocity—and the lower portion of the gluteal muscles C, and the musculature D at approximately the middle of the thigh of the person using the chair.

As will appear from FIG. 1 a comfortable sitting posture is, thus, achieved where the user's back is supported in a backwards inclined position and the user's thighs are supported in a corresponding forwards inclined position and where the angle $\alpha$ between the main directional lines of the thighs and the back, i.e. lines C–D and A–B, is acute and the bisectrix L of said angle is in an approximate vertical position.

FIG. 2 shows an alternative embodiment of the chair according to FIG. 1 with an adjustable, lockable supporting member 4 swingably mounted at the end of an arm 7 swingably mounted at 5 in the underframe 3 of the chair in front of the chair seat 1. Said supporting member 4 is swingable from a rear position 4*a*, where it forms/replaces the upper front portion of seat 1 as shown in FIG. 1 to support the back of the thigh, to a mid-position 4*b* to support the front of the calf, and then to a front position 4*c* to support the back of the calf. Furthermore, said supporting member is swingable to a position 4*d* to support the foot per se. It will appear from FIG. 2 that the supporting member 4 per se is in its first mentioned position 4*a* moved to a parallel position with arm 7 to support the thigh, and support member 4 also has this position in position 4*b* to support the front of the calf and, if desired, the underside of the foot. In the last mentioned position, as shown in FIG. 2, the user's thigh is raised in a very acute angle with the body. In position 4*c* of supporting element 4 it is moved to a position across arm 7 and forms a support to the underside of the calf.

By the aid of said adjustable supporting member 4 support is, thus, achieved for the thigh (back)
calfs (front)
calfs (back)
sole of the foot (underside)

Said supporting member 4 may have a width that is sufficient for supporting both legs at the same time, or there may be provided two supporting elements side-by-side, one on each arm 7 and with the support elements being separately adjustable. In this case a person using the chair can choose an individual posture for each leg.

Having described my invention, I claim:

1. A chair comprising a seat and a backrest supported by an underframe, said seat and said backrest forming an acute first angle $\alpha$ with one another, wherein a line bisecting said angle $\alpha$ forms a second angle in the range of 0°–40° with respect to a vertical line and said bisecting line is inclined backwards toward said backrest when said second angle is more than zero degrees, so that a person sitting in said chair is forced to assume a position wherein the person's thighs and body form an acute angle with respect to each other.

2. A chair as defined in claim 1, with said seat and said back rest being anatomically shaped wherein a first line corresponding to the main direction of the back rest touches a first point, at the upper portion of the back—thoracal column, and a second point, at the back of the sacrum with the upper portion of the gluteal muscles B, respectively, of a person sitting in the chair, and that a second line corresponding to the main direction of the seat touches a third point at the back/lower side of the bones of the pelvis—ischial tuberocity—and the lower portion of the gluteal muscles, and a fourth point at the musculature at approximately the middle of the thigh of said person, said first and second lines defining an acute angle $\alpha$.

* * * * *